United States Patent [19]

Staats

[11] 4,313,044

[45] Jan. 26, 1982

[54] SLOT CONFIGURATION FOR CHOKE SEAL

[75] Inventor: James E. Staats, Louisville, Ky.

[73] Assignee: General Electric Company, Louisville, Ky.

[21] Appl. No.: 204,125

[22] Filed: Nov. 5, 1980

[51] Int. Cl.[3] ..... H05B 6/76

[52] U.S. Cl. ..... 219/10.55 D; 174/35 MS

[58] Field of Search ..... 219/10.55 D, 10.55 F, 219/10.55 R, 10.55 M; 333/81 A; 174/35 MS, 356 C, 35 R

[56] References Cited

U.S. PATENT DOCUMENTS

| | | | |
|---|---|---|---|
| 2,772,402 | 11/1956 | Tomiyasu . | |
| 3,651,300 | 3/1972 | Haagensen | 219/10.55 D |
| 3,767,884 | 10/1973 | Osepchuk et al. | 219/10.55 D |
| 4,053,731 | 10/1977 | Foerstner | 219/10.55 D |
| 4,254,318 | 3/1981 | Ohkawa et al. | 219/10.55 D |

*Primary Examiner*—Arthur T. Grimley

*Attorney, Agent, or Firm*—Radford M. Reams; H. Neil Houser

[57] ABSTRACT

An electromagnetic wave energy seal arrangement for a microwave oven which incorporates juxtaposed conductive surfaces spaced apart by a gap which circumscribes the perimeter of an access opening to the oven cooking cavity. One of the conductive surfaces is located on the oven door, overlies a recessed channel in the door, and is provided with slots to inhibit longitudinal currents. The slots are configured to have a first average width near the slot entrance and a second larger average width adjacent the slot terminus to thereby better tailor the bandwidth of the slots for optimum operation to the specific microwave energy characteristics of the oven.

5 Claims, 3 Drawing Figures

SLOT CONFIGURATION FOR CHOKE SEAL

BACKGROUND OF THE INVENTION

This application is directed to a microwave oven and an improved microwave energy seal for a microwave oven.

A problem in microwave ovens is to maintain the leakage of energy from the microwave oven cavity during operation thereof below the maximum levels established by state and federal regulatory agencies. While currently marketed ovens employ energy seal structures capable of meeting these requirements, there is a continuing desire on the part of manufacturers to improve upon the current seal arrangements and thereby substantially exceed these government standards.

One arrangement known in the art for sealing a microwave oven enclosure employs the generalized teachings of microwave choke structures known for some time in the microwave communication art. An example of such a teaching is U.S. Pat. No. 2,772,402 which is directed to a microwave energy enclosing structure for providing a substantial electric junction between conductive members spaced a small distance apart, thereby inhibiting electrical leakage therefrom. This patent teaches the use, for this purpose, of slots or discontinuities in one conductive member to suppress the propagation of microwave energy longitudinally along the conductive members (generally perpendicular to the direction of the slots). The conductive members in such an arrangement are spaced apart a distance much smaller than the one-quarter wavelength of the microwave energy employed in the system. The lengths of the slots are selected to be approximately an odd multiple of a quarter wavelength (preferably one-quarter wavelength), with the width of the slots being appreciably smaller than one-quarter wavelength and several times smaller than the length thereof. The other conductive surface is preferably continuous, but may alternatively be provided with a slotted configuration.

U.S. Pat. No. 3,767,884 discloses energy sealing structure adapted for use in the microwave oven art which employ a slotted plate similar to the type disclosed in U.S. Pat. No. 2,772,402 and incorporate this slotted plate feature into the more generalized choke arrangement disclosed in U.S. Pat. No. 3,767,884.

OBJECTS AND SUMMARY OF THE INVENTION

It is a general object of this invention to provide a microwave oven energy sealing choke arrangement adapted for use in microwave ovens to reduce the leakage of electromagnetic energy from such ovens.

A further object is the provision of an energy choke arrangement utilizing a slotted plate to inhibit peripheral currents but which increases the overall effectiveness of such a choke by a specific contouring of the shape of the slots.

A still further object is to provide a slotted plate choke arrangement wherein the effectiveness of the slots in inhibiting leakage currents is increased without a proportional increase in the overall length or depth of the slots.

A still further object is to provide an energy seal of the slotted plate type having greater inherent ability to provide optimum energy leakage control for a variety of microwave oven dimensions and excitation systems.

A still further object of the invention is to provide a seal structure which permits reduced tolerances in manufacture while still providing energy leakage prevention meeting government regulatory standards.

These and other objects of the invention are accomplished by the provision of a choke energy seal adapted for use in a microwave oven which includes adjacent conductive walls spaced from each other across a small gap or space bordering the access opening to the oven. One of the walls is provided with slots or openings to inhibit longitudinal current along the periphery of the wall. The slots are configured to have their width vary as a function of the depth of the slots by providing a first average width near the slot entrance and a second larger average width qadjacent the slot terminus. This variation in slot width permits the bandwidth of the slot to be optimized for a particular oven configuration resulting in improved attenuation of any microwave energy leaking from the cavity to the oven exterior.

DESCRIPTION OF THE DRAWINGS

The invention, as well as the details for the provision of a preferred embodiment, will be readily understood after consideration of the following detailed description and reference to the accompanying drawings, wherein.

DESCRIPTION OF THE PREFERRED EMBODIMENT

Figure 1:
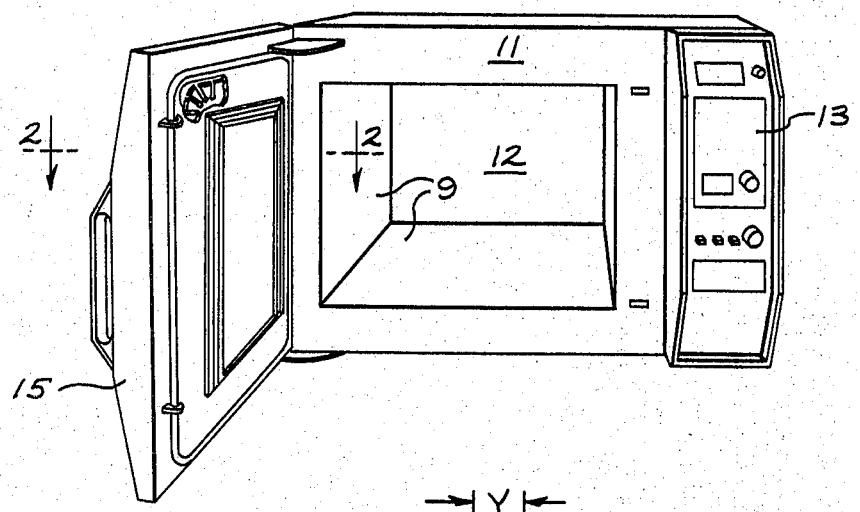
FIG. 1 is a front perspective view of a microwave oven according to the invention with a portion of the access door broken away to reveal the details of the location of the choke seal.

As is shown in FIG. 1, the energy seal of the invention is adapted for use in a microwave oven 10 having a cooking cavity 12 provided with a front facing access opening. The access opening is covered by a hinged door 15. The cavity 12 is in the form of a cubic enclosure defined by orthogonally oriented top, bottom, rear and side conductive walls 9. The access opening is circumscribed by a door frame which includes a generally flat inner wall 11 configured like a rectangular picture frame, through which access to the cavity 12 may be had.

Microwave energy is supplied to the oven cavity 12 in a conventional manner by means of a magnetron (not shown) located in a control compartment (not shown) generally situated behind a user control panel 13. The magnetron is selected to produce microwave energy having a frequency of 2450 MHz which is coupled by conventional coupling lines to the cavity 12. It is understood that numerous other components are required in a complete microwave oven, but are not shown or described herein since they are conventional in nature and, as such, are well known to those skilled in the art.

Figure 3:
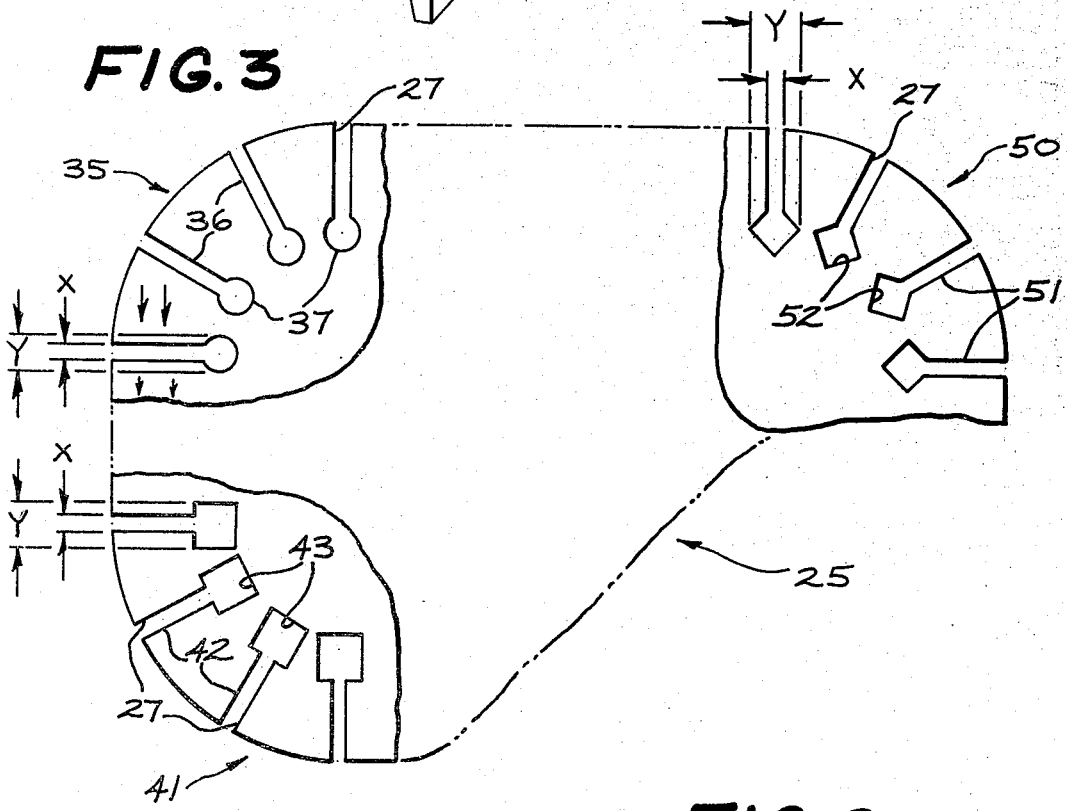
FIG. 3 is a plan view of the slotted conductive plate of the energy seal illustrating the details of alternative constructions for the slots.

The door 15 in the embodiment shown consists of a main sheet metal frame member 16 having generally a rectangular, picture frame shape. The member 16 includes a U-shaped in cross section portion 17, which defines a recessed channel 18 forming the sides of the picture frame shape and running adjacent the periphery of the door 15. The frame 16 also includes an integral planar flange 19 extending generally inwardly from the portion 17 and channel 18. The channel 18 extends around the door to form a closed loop juxtaposed to the inner wall 11 adjacent the access opening to the oven cavity 12. The flange 19 has attached thereto a thin conductive rectangular plate 25 including a section 24 which overlies a portion of the channel 18. The inner edge of the plate 25 defines a central rectangular opening which is covered by a perforated screen 20 fastened by any suitable means, such as by welding, to the inner border of the plate 25. The openings in the screen 20, as is conventional, are selected to be sufficiently small to prevent transmission of microwave energy therethrough but sufficiently large to permit viewing of the oven cavity by a user of the oven. A lamp (not shown) is usually provided to illuminate the cooking cavity to aid in viewing the interior during the cooking process by permitting better visibility through the screen 20. The section 24 of the plate 25 is provided with slots 27, as best seen in FIG. 3, in the portion of the plate overlying the channel 18 which will be described in greater detail hereinafter and which function as part of the energy seal to prevent current flow along the longitudinal periphery of the plate in a direction substantially perpendicular to the extent of the slots 27, as illustrated by the arrows in FIG. 3.

A dielectric gasket 26 is inserted over the outer edge of the member 16 to prevent contact between the electrically conductive portion of the door 15 and the inner wall 11 and to position the channel 18 and plate 25 a preselected distance from the inner wall 11, to thereby form a gap 28 which extends about the perimeter of the access opening between the inner wall 11 and the channel 18. The gasket 26 is of a well known composition and may be impregnated with microwave energy absorption materials to absorb residual microwave energy passing through the gap 28.

Figure 2:
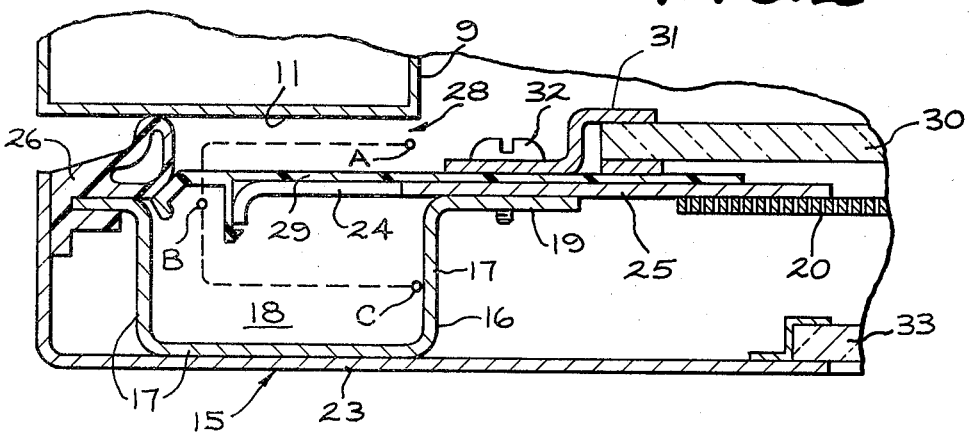
FIG. 2 is a cross-sectional view of the energy seal according to the invention taken along the lines 2—2.

A generally flat plastic cover 29 overlies the plate 25 and spans the space formed between the leftmost edge of the plate 25 (as seen in FIG. 2) and the gasket 26. The cover 29 serves to protect the plate 25 from damage during use of the oven and to prevent food particles and other contaminants from entering the channel 18. The plate 29 may take any suitable form for this purpose.

An outer panel 23 is attached to the member 16 by any suitable means to serve as the outer covering for the door 15 and is provided with a glass or plastic inset 33 which is in alignment with the perforated screen 20 to provide a more desirable outer appearance while still permitting viewing of the cooking cavity interior.

A second glass or plastic panel 30 is held in place on the interior of the door by a flange 31 to be in alignment with the perforated screen 20 to prevent dirt and food products residue from coming into contact with the screen 20.

A screw 32 serves as the common fastening means for holding the plate 25, cover element 29 and flange 31 to the main frame member 16, but other suitable fastening means may be alternatively employed for this purpose.

So as to prevent microwave energy from leaking from the cooking cavity 12 through the gap 28, the channel 18 and plate 25 cooperate with the wall 11 to form a choke-type seal along the entire circumference of the door in the region of the gap 28. The overall operation of such a choke is well known in the prior art and is described in detail in the aforementioned patents. For the sake of completeness, a brief description of its operation will now be given.

The choke generally comprises the U-shaped member 16, the portion 24 of plate 25 and the inner wall 11. These members jointly serve to provide a first transmission path defined generally between points A and B in FIG. 2 along the dotted lines, this path being bounded generally by walls 11 and plate portion 24. A second electromagnetic energy transmission path is defined between points B and C along the dotted lines, their paths being defined by plate portion 24 and the U-shaped portion 17, the rightmost upstanding wall thereof 17 (coincident with point C) forming a terminating conductive surface wall of the choke.

The dimension from the point designated by the letter A to the midpoint designated by the letter B is approximately one-quarter wavelength of the operating frequency of the electromagnetic energy used in the oven. Similarly, a distance of one-quarter wavelength is provided between the point B and the terminating conductive wall surface indicated by the letter C. The total overall choke transmission path thereby provided is approximately equal to one-half wavelength from the point A. Alternatively, the overall choke transmission length may be an integer multiple of half-wavelengths without changing the principle of its operation. In operation, the above noted energy seal defines a choke structure analogous to conventional parallel plate radio frequency transmission line circuits to provide a path of least resistance for the escaping microwave energy. The gap 28 about the access opening provides a path (A to B) of substantially one-quarter wavelength before the radiated energy contacts a metallic conductive surface. The energy is then reflected or transferred along the path B to C of one-quarter wavelength terminating in the conductive surface at C. As a result of these parameters, an electrical short circuit or low impedance at the point C is reflected as a short circuit at the point A or the point of origin of the gap 28. Thus, electromagnetic energy escaping from the oven will be prevented from leaking from the edges of the door.

The energy seal, in addition to providing a low impedance path across the gap 28, also inhibits the propagation of microwave energy longitudinally in the choke itself. This is accomplished by means of the above-noted slots or serrations 27 which provide, in accordance with principles known in the art, impedance discontinuities.

While the prior art teachings on the function and design of the slots emphasizes their overall function in inhibiting longitudinal currents, no discussion is provided in the art for tailoring the shape of the slots for optimal performance in conjunction with various oven cavities having different frequency characteristics. Specifically, the prior art suggests only a rectangular shape which has been found to provide less than optimal attentuation of microwave energy over the band of frequencies encountered in particular oven designs.

The instant invention therefore is specifically directed to new and different configurations for such slotted plate chokes which provide more effective bandwidth characteristics and thereby even further reduce leakage of microwave energy from the oven cavity.

Such slots operate generally by attentuating a given band of frequencies, the term "bandwidth" being used to designate the span of frequencies over which effective attentuation is provided. The typical rectangular slot shown in the prior art is characterized by a wide bandwidth which, while very effective, is less than optimal.

Generally speaking, the width of these slots is much less than a quarter wavelength, typically about $\frac{1}{4}$ inch for a 2450 MHz oven. The length of the slots and spacing between slots is usually less than one quarter wavelength, typically in the range from $\frac{3}{4}$ to 1 inch for a 2450 MHz oven.

Within the general confines of these overall dimensions, it has been found that by varying the width of the slots 27 as a function of the depth of the slots, greater control can be exercised over the bandwidth of the slots and thus over the effectiveness of the seal in preventing longitudinal currents.

More specifically, it has been found that by changing the width of the slots 27 as a function of its depth greater control over the bandwidth of the slots may be achieved. Thus, for a given width opening at the entrance or mouth of a slot the bandwidth of a slot as a whole may be decreased progressively by widening the portion of the slot adjacent the terminus of the slot.

Examples of specific slot configurations in accordance with the invention are shown in FIG. 3. A first set of slots 35 is characterized by a first segment 36 adjacent the slot entrance or mouth having an average width denoted "X" and a second segment 37 nearest the terminus of the slot having an average width "Y" which is greater than "X". The segment 37 is in the form of an approximate circle, but any arcuate shape would suffice.

An alternate slot configuration 41 is also shown having similar segments 42 and 43 characterized by different relative or average widths "X" and "Y", the wider segment 43 being generally in the form of a rectangle.

Lastly, a slot set 50 is depicted having a first relatively narrow width 51 adjacent the slot entrance and a second relatively larger width 52 in the general form of a diamond adjacent the end of the slot.

While the variation in the width of the slot as a function of the depth is the key principle of the invention, it has been found that slots having bandwidths which are optimal for a large number of oven configurations incorporate wider average width segments near the terminus of the slots and narrower segments adjacent the mouths of the slots.

A theoretical explanation for this is as follows: The bandwidth of a given slot is a function of the capacitive and inductive properties of the slot. The capacitance of a slot is most strongly affected by the spacing or width of the slot adjacent the mouth or entrance of the slot. The inductance of the slot is affected most strongly by the width of the slot near the terminus. Thus, by changing the ratio of the slot width adjacent the entrance to that adjacent the terminus the capacitive and inductive characteristics and therefore the overall bandwidth of the slot may be tailored for a given oven.

Additional energy seal arrangements with numerous modifications, variations or alterations may be practiced by those skilled in the art and are considered to be within the spirit and scope of the invention as defined in the appended claims. It is intended, therefore, that the foregoing description be considered as illustrative only and not in a limiting sense.

What is claimed is:

1. In a microwave oven apparatus comprising an enclosure having a cooking cavity located therein, said enclosure including a first planar conductive surface which partly defines an access opening to said cavity to permit food to be placed in said cavity, means for supplying electromagnetic energy to said cooking cavity, a movable door including choke-type seal means for cooperating with said first surface for inhibiting the escape of said electromagnetic wave energy from said cavity, said seal means including a second conductive surface spaced from said first surface by a small distance and running parallel thereto to define a gap about said access opening, said second surface provided with a plurality of slots extending generally perpendicular to the longitudinal extent of said surface, the improvement wherein said slots include sections which vary in width as a function of the depth of the slot.

2. The combination recited in claim 1 wherein a second surface overlies a recessed channel, the dimension of said channel along said second surface being approximately one-quarter wavelength of said electromagnetic energy.

3. The combination recited in claim 1 wherein said sections include first sections nearest the mouths of said slots and second sections nearest the terminus of said slots, said second sections having a larger width than said first section.

4. The combination recited in claim 3 wherein said second sections are generally circular in shape.

5. The combination recited in claim 3 wherein said second sections are generally rectangular in shape.

* * * * *